US010625331B2

(12) United States Patent
Han et al.

(10) Patent No.: US 10,625,331 B2
(45) Date of Patent: Apr. 21, 2020

(54) METHOD OF MANUFACTURING BENT RAZOR BLADES

(71) Applicant: The Gillette Company LLC, Boston, MA (US)

(72) Inventors: Wei Han, Sudbury, MA (US); Ming Laura Xu, Natick, MA (US); John Lawrence Maziarz, Framingham, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 15/784,453

(22) Filed: Oct. 16, 2017

(65) Prior Publication Data

US 2018/0126574 A1 May 10, 2018

(30) Foreign Application Priority Data

Nov. 7, 2016 (EP) ..... 16197630

(51) Int. Cl.

| | |
|---|---|
| ***B21D 53/64*** | (2006.01) |
| ***B26B 21/56*** | (2006.01) |
| ***B26B 21/06*** | (2006.01) |
| ***B26B 21/22*** | (2006.01) |
| ***B26B 21/40*** | (2006.01) |

(52) U.S. Cl.

CPC ..... *B21D 53/645* (2013.01); *B26B 21/06* (2013.01); *B26B 21/222* (2013.01); *B26B 21/4068* (2013.01); *B26B 21/565* (2013.01)

(58) Field of Classification Search

CPC ..... B21D 53/645; B26B 21/06; B26B 21/565
USPC ..... 76/DIG. 8, 101.1; 30/47–51
See application file for complete search history.

(56) References Cited

U.S. PATENT DOCUMENTS

| | | | | |
|---|---|---|---|---|
| 7,823,272 | B2 * | 11/2010 | Guay | B21D 53/645 30/40.1 |
| 8,011,104 | B2 * | 9/2011 | Masek | B21D 53/645 30/50 |
| 8,347,512 | B2 * | 1/2013 | Masek | B21D 53/645 30/50 |
| 8,499,462 | B2 * | 8/2013 | Masek | B21D 53/645 30/346.54 |
| 8,640,344 | B2 * | 2/2014 | Masek | B21D 53/645 30/50 |
| 8,752,300 | B2 * | 6/2014 | Masek | B21D 53/645 76/DIG. 8 |
| 9,868,221 | B2 * | 1/2018 | Van Eibergen Santhagens | B21D 53/645 |

(Continued)

FOREIGN PATENT DOCUMENTS

| | | | | |
|---|---|---|---|---|
| EP | 3318374 A1 * | 5/2018 | ..... | B21D 53/645 |
| WO | WO-2004112986 A1 * | 12/2004 | ..... | B21D 53/645 |

OTHER PUBLICATIONS

Extended EPO Search Report in corresponding international application 16197630.3 dated Apr. 26, 2017.

*Primary Examiner* — Jason Daniel Prone
(74) *Attorney, Agent, or Firm* — John M. Lipchitz

(57) ABSTRACT

A method of manufacturing a razor blade by providing a razor blank strip having an edge. The razor blank strip is hardened to a hardness greater than 600HV. A pre-bending zone that is spaced apart from an edge of the razor blank is melted with a laser beam. The pre-bending zone is cooled after melting to form a re-solidification portion. The razor blank strip is segmented into individual blades. The individual blades are bent in the pre-bending zone.

13 Claims, 4 Drawing Sheets

(56) References Cited

U.S. PATENT DOCUMENTS

| | | | | |
|---|---|---|---|---|
| 2007/0124939 | A1* | 6/2007 | Van Eibergen Santhagens | B21D 53/645 30/50 |
| 2007/0234577 | A1 | 10/2007 | Masek et al. | |
| 2011/0010929 | A1* | 1/2011 | Guay | B21D 53/645 29/705 |
| 2011/0239466 | A1* | 10/2011 | Van Eibergen Santhagens | B21D 53/645 30/50 |
| 2011/0314678 | A1 | 12/2011 | Peterson | |
| 2014/0041234 | A1* | 2/2014 | Masek | B21D 53/645 30/50 |
| 2016/0361828 | A1* | 12/2016 | Xu | B21D 53/645 |
| 2018/0170084 | A1* | 6/2018 | Board | B21D 53/645 |

* cited by examiner

METHOD OF MANUFACTURING BENT RAZOR BLADES

FIELD OF THE INVENTION

The present invention relates to razor blades in general and, more specifically, to razor blades having a bent portion and a method for manufacturing the same.

BACKGROUND OF THE INVENTION

In general, a cartridge or blade unit of a safety razor has at least one blade with a cutting edge, which is moved across the surface of the skin being shaved by means of a handle to which the cartridge is attached. Some shaving razors are provided with a spring-biased cartridge that pivots relative to the handle to follow the contours of the skin during shaving. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled. Razor cartridges usually include a guard, which contacts the skin in front of the blade(s) and a cap for contacting the skin behind the blade(s) during shaving. The cap and guard may aid in establishing the so-called "shaving geometry", i.e., the parameters which determine the blade orientation and position relative to the skin during shaving, which in turn have a strong influence on the shaving performance and efficacy of the razor. The cap may comprise a water leachable shaving aid to reduce drag and improve comfort. The guard may be generally rigid, for example formed integrally with a frame or platform structure which provides a support for the blades. Guards may also comprise softer elastomeric materials to improve skin stretching.

Wet shaving razors have evolved over the years to include unitary blade members that do not require a blade to be welded to a bent blade support member. Such razor cartridges have begun to be manufactured successfully. However, these razor blades have significant design limitations in order to avoid cracking and breaking of the razor blades during the bending process, such as using thinner blade blanks, larger bend radii and softer steels. Even small scratches and small surface defects in a pre-bending zone can lead to larger cracks or complete failure when the blade is bent in this area. Smaller bend radii put even more stress on the bending zone, thus further increasing the likelihood of failure. Furthermore, cracks in the bending zone also provide initiation sites that facilitate further fracture or even breakage of the razor blade during normal use when mounted in a cartridge housing. Cracks may also facilitate accelerated corrosion that results in failure of the razor blade during use. Failure or fracture of a razor blade can result in an uncomfortable shave to a user. Thus, there is a need for a razor blade manufacturing method that allows for bending of the blade body with minimal cracking or failure of the blade due to surface scratches or imperfections.

SUMMARY OF THE INVENTION

In one aspect, the invention features, in general, a method of manufacturing a razor blade. A razor blank strip having an edge is provided. The razor blank strip is hardened to a hardness greater than 600 HV. A pre-bending zone that is spaced apart from an edge of the razor blank is melted with a laser beam. The pre-bending zone is cooled after melting to form a re-solidification portion. The razor blank strip is segmented into individual blades. The individual blades are bent in the pre-bending zone.

In another aspect, the invention features, in general a blade having a cutting edge with a hardness greater than 600 HV. The blade has a base portion with a hardness greater than 600 HV and a bent portion between the cutting edge and the base portion. The bent portion has a hardness less than 500 HV and an outer surface with a re-solidified portion.

The details of one or more embodiments of the invention are set forth in the accompanying drawings and the description below. Other features and advantages of the invention will be apparent from the description and drawings, and from the claims.

DETAILED DESCRIPTION OF THE INVENTION

Figure 1:
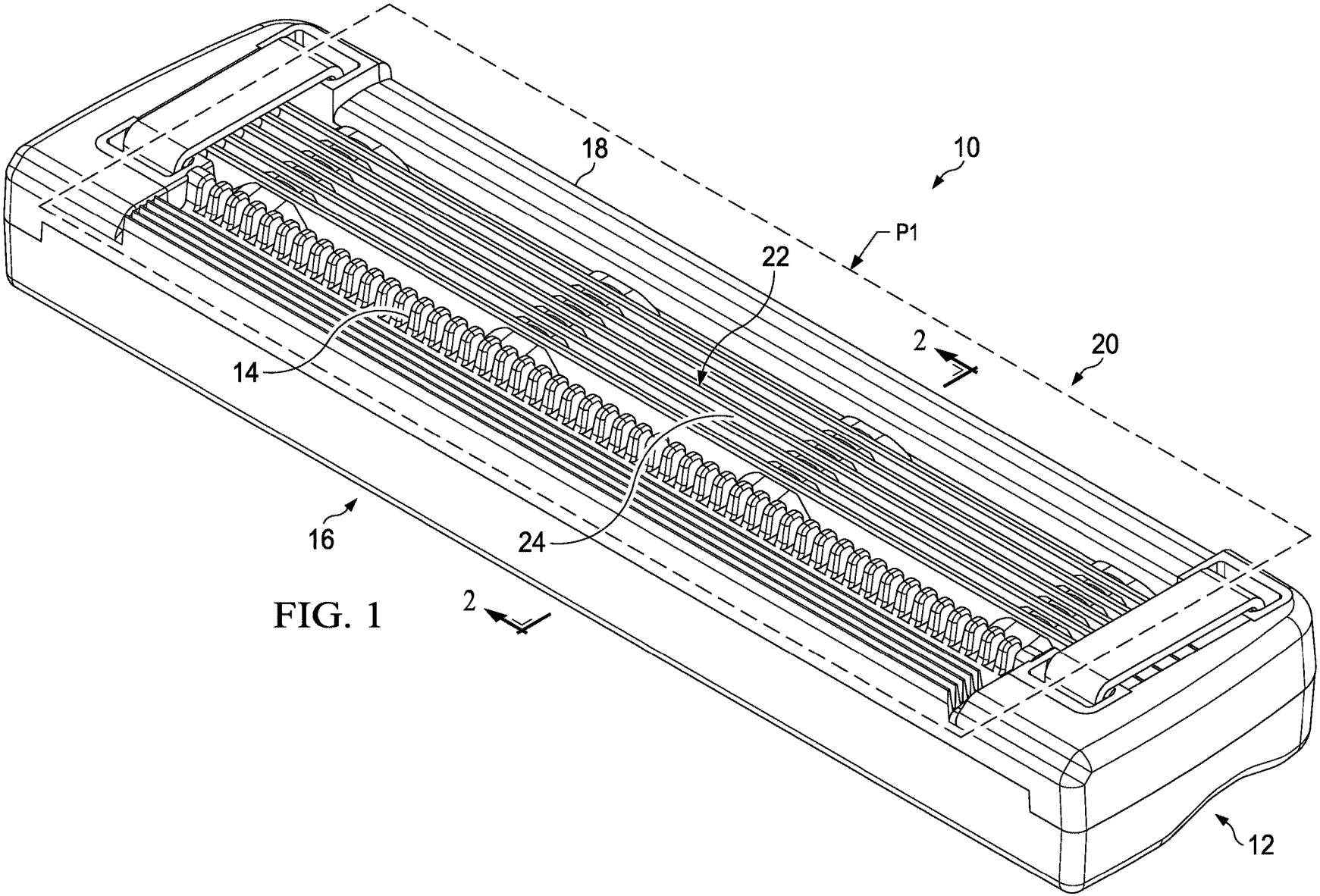
FIG. 1 is a perspective view of a shaving razor cartridge.

Referring to FIG. 1, a perspective view of a shaving razor cartridge 10 is shown. The shaving razor cartridge 10 may be mounted to the handle (not shown). The shaving razor cartridge 10 may be removable or permanently mounted to the handle. For example, the shaving razor cartridge 10 may be mounted detachably on a handle to enable the shaving razor cartridge 10 to be replaced by a fresh shaving razor cartridge 10 when the blade sharpness has diminished to an unsatisfactory level, or it may be attached permanently to the handle with the intention that the entire razor be discarded when the blade or blades have become dulled. The shaving razor cartridge 10 may include a housing 12. The housing 12 may be molded out of plastic or manufactured from other materials, such as metal. A guard 14 may be positioned at a front portion 16 of the housing and a cap 18 may be positioned at a rear portion 20 of the housing 12. One or more blades 22 may be mounted to the housing 12 between the cap 18 and the guard 14 (i.e., in front of the cap 18 and behind the guard 14). The guard 14 may be a unitary molded member that can be formed as part of the housing 12. The guard 14 may be a solid or segmented bar that extends generally parallel to the blades 22 and support the skin during a shaving stroke. Each blade 22 may each have a respective cutting edge 24 generally directed towards the guard 14. The cutting edge 24 may have an ultimate tip radius of 1000 angstroms or less. Although five blades 22 are shown, the housing 12 may have more or fewer blades depending on the desired performance and cost of the shaving razor cartridge 10. The blades 22 may have a length of about 35-40 mm. The guard 14 and the cap 18 may define a shaving plane P1 that is tangent to the guard 14 and the cap 18. In certain embodiments, the cap 18 may comprise one or more lubricants that are released during a shaving stroke.

Figure 2:
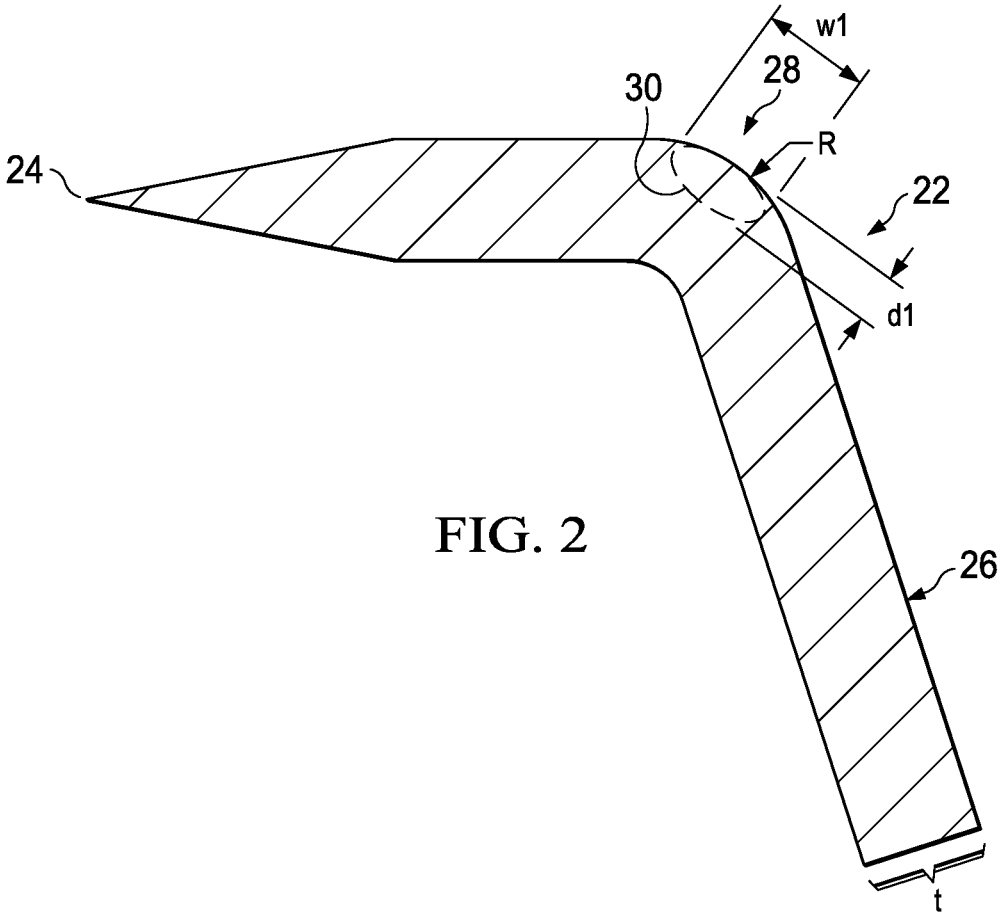
FIG. 2 is a cross section view of a blade, taken generally along the line 2-2 of FIG. 1.

Referring to FIG. 2, a cross section of one of the blades 22 is shown, taken generally along the line 2-2 of FIG. 1. The blade 22 may have a thickness "t" of about 0.030 mm to about 0.10 mm. The blade 22 may be a bent blade unit. For example, the blade 22 may comprise a unitary member having a base portion 26 and respective bent portion 28. The base portion 26 of the blade 22 may be generally transverse to the shaving plane P1 (see FIG. 1). The bent portion 28 may extend between the base portion 26 and the respective cutting edge 24. As will be explained in greater detail below, the bent portion 28 may have a re-solidified portion 30. In certain embodiments, the re-solidified portion 30 may include the entire bent portion 28. The re-solidified portion 30 may have a depth "d1" less than 15% of a thickness of the blade 24. Accordingly, if the thickness of the blade 22 is about 74 microns, then the re-solidified portion 30 may be approximately 10 microns in depth. The re-solidified portion 30 may also extend along a width "w1" of about 0.3 mm to about 1.0 mm. The re-solidified portion 30 may also have a hardness less than 500 HV, or even less than 400, for example, about 400 HV to about 300 HV. The melting may decrease a hardness of the pre-bending zone to 300 HV to 500 HV. In certain embodiments, the bent portion 28 may have a radius "R" less than 0.45 mm, for example, about 0.3 mm to 0.40 mm A smaller bend radius may provide for improved performance of the shaving razor cartridge 10. For example, smaller bend radii of the blades 22 may allow for a narrower cartridge profile and improved rinsing between the blades 22. However, smaller bend radii are difficult to achieve especially with certain types of steel (i.e., small bend radii may cause cracking or failure of the blade 22). In certain embodiments, the blade 22 may comprise a steel having about 0.35 to about 0.75 weight percent carbon, about 12 to about 14.5 weight percent chromium, about 0 to about 5 weight percent molybdenum, and a remainder balance of iron and impurities, such as silicon, sulfur, phosphorus, manganese and nickel.

Figure 3:
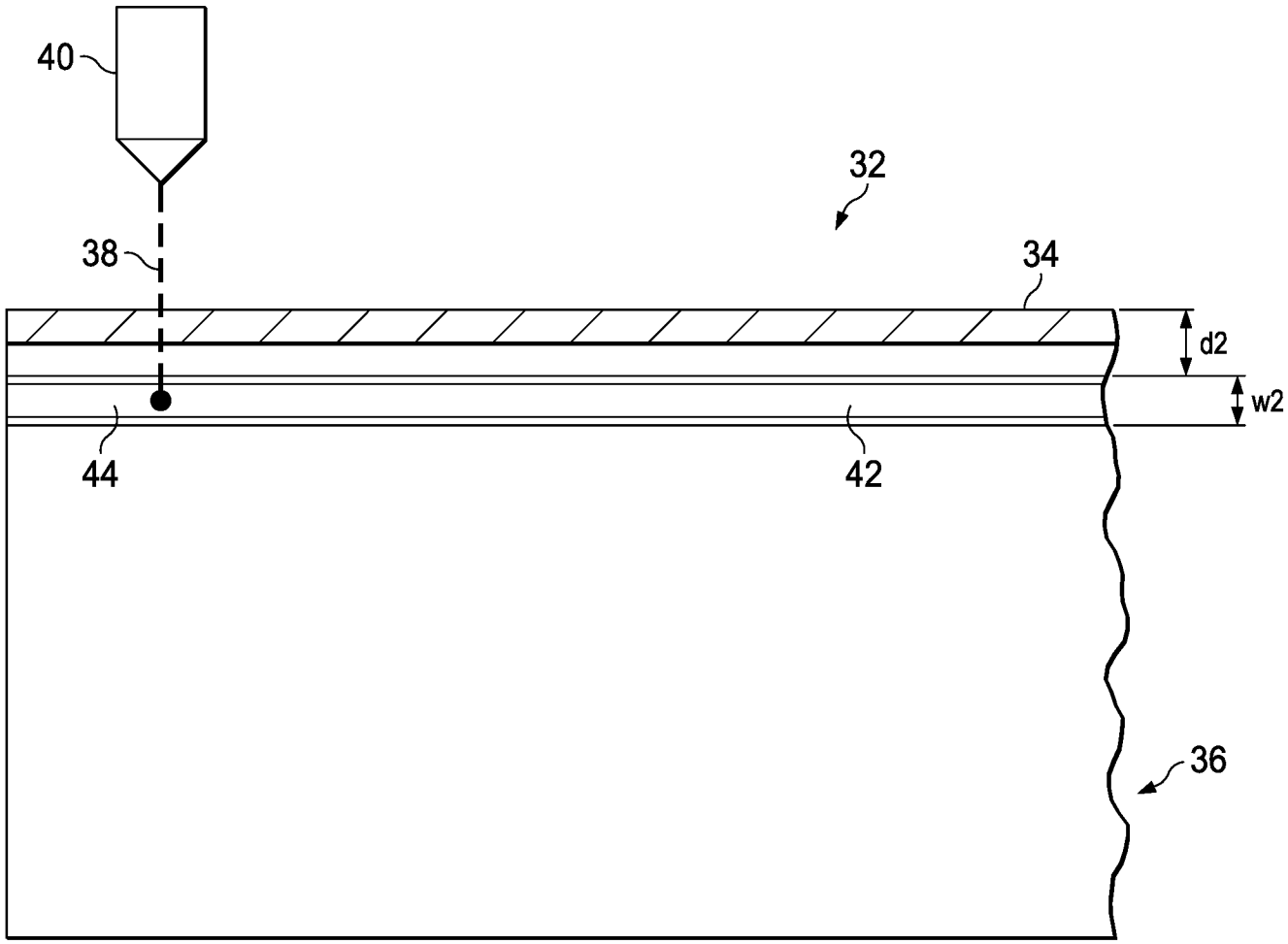
FIG. 3 is a schematic representation of a razor blank strip and a laser.

Referring to FIG. 3 a schematic view of a razor blank strip 32 is shown. In certain embodiments, the razor blank strip 32 may be separated into the individual blades 22 of FIG. 1. The razor blank strip 32 may have an edge 34 and an opposing end portion 36. The edge 34 may go through a grinding process to form the cutting edge 24 of the blade 22 (see FIG. 1). The opposing end portion 36 may eventually become the base portion 26 of the blade 22 (see FIG. 1). The razor blank strip 32 may go through a hardening process prior to forming the cutting edge 22. The razor blank strip 32, for example, the edge 34, may have a hardness greater than 600 HV after the hardening process to allow for a sufficient sharpness to be achieved.

In certain embodiments, after the hardening process, the razor blank strip 32 may be treated with a laser beam 38 (i.e., generated from a laser 40) in a pre-bending zone 42. The pre-bending zone 42 may have a width "w2" of about 0.3 mm to about 1.0 mm. The pre-bending zone 42 may be spaced apart from the edge 34 by a distance "d2" of about 0.4 mm to about 1.2 mm. The laser 40 may project the beam 38 onto the surface of the pre-bending zone 42 to form a melted portion 44 of the razor blank strip 32. The power of the laser beam 38 may be about 0.12 Joules. The laser beam 38 may have a width of about 0.010 mm to about 0.10 mm. In certain embodiments, the beam 38 may have a circular projection (e.g., round or oval) or a non-circular projection (e.g., rectangular). The laser beam 38 may be applied about 0.5 mm to about 1.2 mm from the edge 34. The treatment of the pre-bending zone 42 may cause localized melting of the steel (or other metal), which may fill in any surface scratches that may have resulted from the various processes and handling operations of the razor blank strip 32. Even small scratches in the pre-bending zone 42 may result in cracks or even failure during and after bending. The laser beam 38 may locally increase the temperature of the pre-bending zone 42 to the material's melting point for a short period of time. It is understood the laser beam 38 may not completely melt the material in the pre-bending zone 42 (e.g., mixture of liquid and austenite). The laser beam 38 may increase a surface temperature of the pre-bending zone 42 higher than a temperature that anneals or softens the steel. For example, the pre-bending zone 42 may be heated by the laser beam 38 to a temperature greater than 1100 C or even greater than 1300 C (measured at the outer surface) for about 0.3 milliseconds. Accordingly, local melting from the laser beam 38 may not only decrease the hardness of the pre-bending zone 42 to improve ductility in this area, but may also remove scratches that can propagate during later processing which may lead to cracking and failure. In certain embodiments, the edge 34 may go through a grinding process after the laser process to form the cutting edge 24, as shown in FIGS. 1 and 2. In addition, locally heating the pre-bending zone 42 to the high temperatures previously mentioned may not change the hardness of the edge 34 significantly thus allowing a sufficient grinding to a high performance cutting edge 24.

Figure 4:
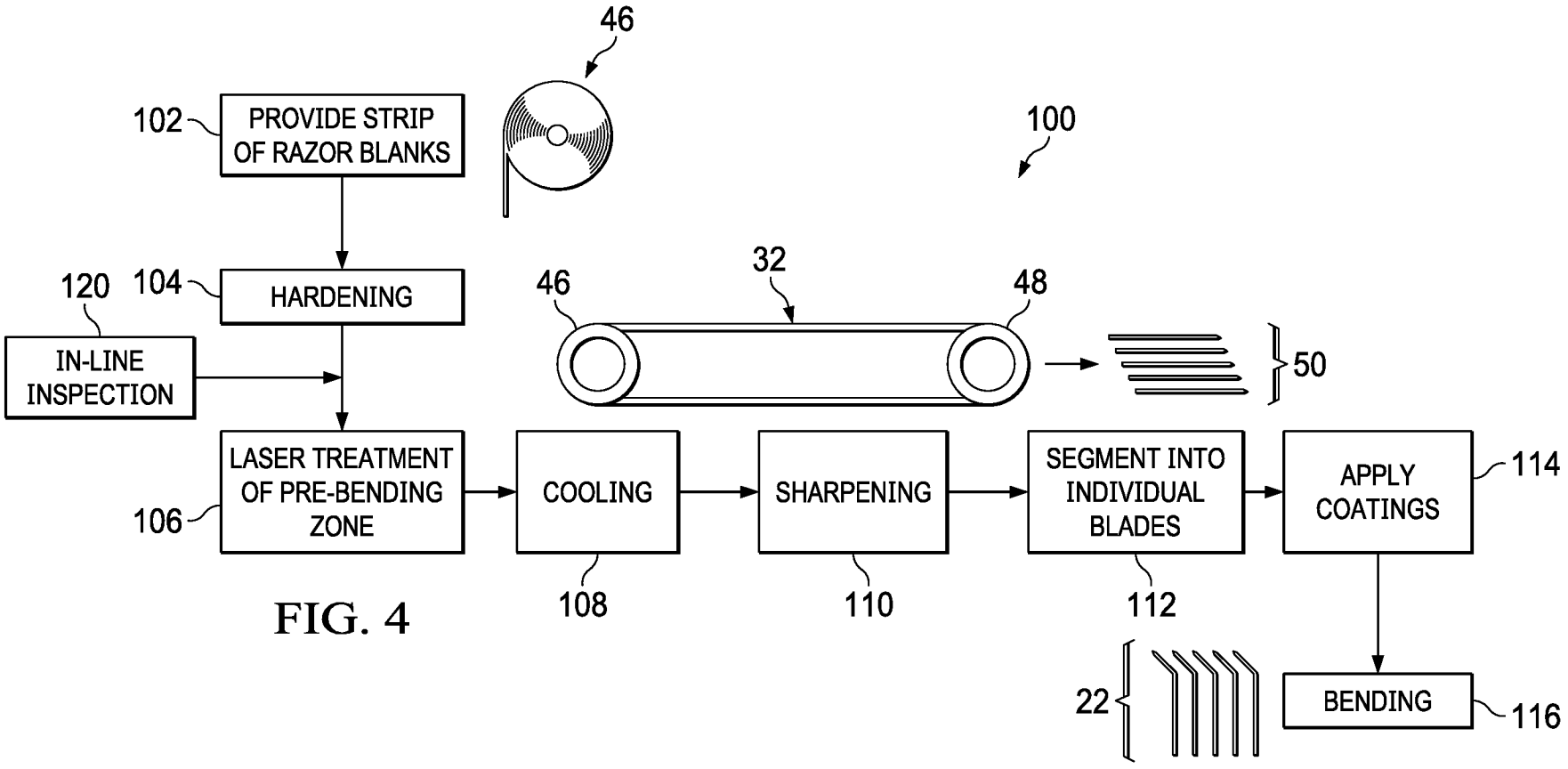
FIG. 4 is a process flow diagram for manufacturing the blade of FIG. 2.

Referring to FIGS. 3 and 4, one possible embodiment of a blade process will be described. FIG. 4 illustrates a schematic view of one possible embodiment of a blade process 100 is shown. A first step 102 may include providing the razor blank strip 32 of FIG. 3. For example, the razor blank strip 32 shown in FIG. 3 may be provided on a supply reel 46. The strip of razor blanks 32 may go through a hardening step 104 to increase the hardness and strength of the strip of razor blanks 32. After the hardening step 104, the strip of razor blanks 32 may go through a laser treatment (i.e., melting process) 106 of the pre-bending zone 42 resulting in the melted portion 44 (see FIG. 3). The melting process does not need to melt the entire thickness of the pre-bending zone 42. The pre-bending zone 42 may be melted to a depth less than 35% of a thickness of the razor blanks 32. For example, the pre-bending zone 42 may be melted to a depth less than 15% of a thickness of the blade 24. Accordingly, if the blade 22 has a thickness of about 74 microns, then the melting may occur up to a 10 micron depth. The melting process may also decrease a hardness of the pre-bending zone 42 of the blank below 400 HV, for example, about 350 HV to about 300 HV. In certain embodiments, the melting and re-solidifying process may decrease the hardness of the pre-bending zone 42 by about 40% to about 50%, thus reducing the potential of brittle failure or crack propagation during bending, while still providing sufficient strength and support. In certain embodiments, the melting process (i.e., applying the laser beam to the pre-bending zone 42) may be performed in the presence of shield gas comprising argon, helium, nitrogen or any combination thereof to change the color of the blades or stabilize the color of the blades.

After the razor blade strip 32 is locally melted by the laser beam 38, the razor blade strip 32 may go through a cooling step 108 to re-solidify the melted portion 44 (see FIG. 3), thus resulting in the re-solidified portion 30 (see FIG. 2). In certain embodiments, the razor blade strip 32 may be cooled at room temperature or pass through an active cooling station. For example, the razor blade strip 32 may be cooled by remaining at room temperature for a certain period of time or may pass through a cooling station that uses chilled air or water to cool the razor blanks. In certain embodiments, the razor blade strip 32 may be cooled to ambient temperature about 20° C. degrees to about 26° C. It is understood that the razor blade strip 32 may be stored on the take-up reel 48 after the cooling step 108 for later processing. In certain embodiments, the melting and cooling processes may remove scratches in the pre-bending zone 42 less than 10 microns deep, for example, 5-10 micron deep. The melting and cooling may remove scratches and surface imperfections in the pre-bending zone less than 0.020 mm deep.

In certain embodiments, the razor blade strip 32 may be tensioned during melting and cooling. The tensioning of the razor blade strip 32 may improve flatness and straightness along its length by minimizing thermal distortion. For example, the razor blade strip 32 may be tensioned between the supply reel 46 and a take-up reel 48. The speed of the reels may be controlled to provide continuous tension of the razor blade strip 32. The application of a take up reel and supply reel may also facilitate continuous melting of the razor blade strip 32 by the laser 40.

After the cooling step 108 the razor blade strip 32 may go through a sharpening step 110 where the edge 34 is formed into sharp cutting edges 24, for example, by grinding. The razor blade strip 32 may then pass to a segmenting step 112 where the strip of razor blanks 32 are separated into individual razor segments 50. Various coatings may be applied to the segmented blanks 50 in a coating step 114. For example, the coatings step may include sintering and/or the application of one or more hard coatings or lubricious coatings, such as PTFE.

After coatings are applied, the razor segments 50 may go through a bending step 116 where the razor segments 50 are bent to form the blades 22 of FIG. 2. The bending of the razor segments 50 may be carried out by a coining process, swivel bending or any other common bending processes known to those skilled in the art. The bending process may bend the razor segments 50 in the pre-bending zone 42 with minimal crack propagation because the bent portion 28 no longer has any scratches due to the localized melting and re-solidifying of the material in pre-bending zone 42. The blade process 100 may optionally include an inline inspection step 120. The inline inspection step 120 may inspect the pre-bending zone 42 for surface scratches to determine if the laser treatment step 106 is required. For example, if scratches are below a certain length and/or depth, the laser treatment step 106 may be skipped.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of manufacturing a plurality of razor blades comprising:
- providing razor blank strip having an edge;
- hardening the razor blank strip to a hardness greater than 600 HV;
- melting a pre-bending zone of the razor blank strip that is spaced apart from the edge with a laser beam;
- cooling the pre-bending zone after said melting to form a re-solidified portion;
- segmenting the razor blank strip into individual blades; and
- bending the individual blades in the pre-bending zone to form a bent portion.

2. The method of claim 1 further comprising applying one or more coatings to the individual blades prior to bending.

3. The method of claim 1 further comprising tensioning the strip of razor blanks during said melting and said cooling.

4. The method of claim 1 wherein a surface temperature of the pre-bending zone is at ambient temperature during said bending.

5. The method of claim 1 wherein the laser beam has a width of 0.01 mm to 0.10 mm.

6. The method of claim 1 wherein the laser beam is applied about 0.5 mm to about 1.2 mm from the edge of the razor blank.

7. The method of claim 1 wherein melting and said cooling comprises removing scratches and surface imperfections in the pre-bending zone less than 0.020 mm deep.

8. The method of claim 1 wherein said melting comprises decreasing a hardness of the pre-bending zone to 300 HV to 500 HV.

9. The method of claim 1 wherein said melting comprises melting the pre-bending zone to a depth less than 35% of a thickness of the blank.

10. The method of claim 1 wherein said melting is performed in the presence of an argon, helium, or nitrogen gas.

11. The method of claim 1 further comprising inspecting the pre-bending zone for scratches prior to said melting.

12. A method of manufacturing a plurality of razor blades comprising:
- providing razor blank strip having an edge;
- hardening the razor blank strip to a hardness greater than 600 HV;
- melting a pre-bending zone of the razor blank strip that is spaced apart from the edge with a laser beam;
- cooling the pre-bending zone after said melting to form a re-solidified portion;
- tensioning the strip of razor blanks during said melting and said cooling;
- segmenting the razor blank strip into individual blades; and
- bending the individual blades in pre-bending zone, wherein said melting comprises heating the pre-bending zone with the laser beam to a temperature greater than 1100 C.

13. The method of claim 12 wherein the laser beam is applied about 0.5 mm to about 1.2 mm from the edge of the razor blank.

* * * * *